US009147950B2

(12) United States Patent
Ballard

(10) Patent No.: US 9,147,950 B2
(45) Date of Patent: Sep. 29, 2015

(54) CONNECTOR ASSEMBLY AND DEVICE AND METHODS OF ASSEMBLING SAME

(75) Inventor: Kenneth Ballard, King, NC (US)

(73) Assignee: Precision Concepts Group LLC, Winston-Salem, NC (US)

( * ) Notice: Subject to any disclaimer, the term of this patent is extended or adjusted under 35 U.S.C. 154(b) by 234 days.

(21) Appl. No.: 13/480,611

(22) Filed: May 25, 2012

(65) Prior Publication Data

US 2012/0302105 A1 Nov. 29, 2012

Related U.S. Application Data

(60) Provisional application No. 61/489,869, filed on May 25, 2011.

(51) Int. Cl.
*H01R 11/00* (2006.01)
*H01R 12/58* (2011.01)

(52) U.S. Cl.
CPC ..... *H01R 12/58* (2013.01)

(58) Field of Classification Search
CPC ..... H01R 12/774; H01R 12/58; H01R 13/40
USPC ..... 439/752
See application file for complete search history.

(56) References Cited

U.S. PATENT DOCUMENTS

| | | | | | |
|---|---|---|---|---|---|
| 4,544,220 | A * | 10/1985 | Aiello et al. | 439/594 |
| 4,810,208 | A * | 3/1989 | Hayes et al. | 439/589 |
| 5,020,933 | A | 6/1991 | Salvestro et al. | |
| 5,328,382 | A * | 7/1994 | Pawlicki | 439/273 |
| 5,348,498 | A * | 9/1994 | Morello et al. | 439/877 |
| 5,738,546 | A | 4/1998 | Burroughs et al. | |
| 6,053,753 | A * | 4/2000 | Kunkle | 439/275 |
| 6,250,952 | B1 * | 6/2001 | Shiga et al. | 439/466 |
| 6,332,803 | B1 * | 12/2001 | Matsuda et al. | 439/488 |
| 6,361,378 | B1 * | 3/2002 | Konoya et al. | 439/752 |
| 6,524,130 | B1 * | 2/2003 | Yeh | 439/541.5 |
| 6,527,564 | B1 * | 3/2003 | Yeh | 439/76.1 |
| 6,846,996 | B2 | 1/2005 | Kent et al. | |
| 7,075,023 | B2 | 7/2006 | Kent et al. | |
| 7,256,362 | B2 | 8/2007 | Kent et al. | |
| 7,273,992 | B2 | 9/2007 | Kent et al. | |
| 7,281,324 | B2 * | 10/2007 | Kent et al. | 29/846 |
| 7,351,095 | B2 | 4/2008 | Olsen | |
| 7,393,144 | B2 | 7/2008 | Khemakhem et al. | |
| 7,411,127 | B2 | 8/2008 | Viguerie | |
| 7,417,197 | B2 | 8/2008 | Kent et al. | |
| 7,479,019 | B2 | 1/2009 | Kent et al. | |
| 7,507,114 | B2 | 3/2009 | Kent et al. | |
| 7,585,181 | B2 | 9/2009 | Olsen | |
| 7,718,927 | B2 | 5/2010 | Kent et al. | |
| 8,100,720 | B2 * | 1/2012 | Lin et al. | 439/607.34 |
| 8,550,860 | B2 * | 10/2013 | Dick et al. | 439/752 |
| 2004/0127078 | A1 * | 7/2004 | Tondreault et al. | 439/98 |

* cited by examiner

*Primary Examiner* — Truc Nguyen
(74) *Attorney, Agent, or Firm* — Kilpatrick Townsend & Stockton LLP

(57) ABSTRACT

A device and an assembly related to connecting cables, wires, and electrical devices are described herein. The device can include a retainer, subretainer, and at least one contact pin in some embodiments. The retainer and subretainer can be removably coupled. The at least one contact pin can be positioned within channels of the retainer and the subretainer. In other aspects, a device can include a retainer, a subretainer, a retainer clip, a circuit web, and at least contact pin. The at least one contact pin can be position within channels of the retainer, the subretainer, and the retainer clip. Also described herein are methods of manufacturing a connector device.

19 Claims, 8 Drawing Sheets

CONNECTOR ASSEMBLY AND DEVICE AND METHODS OF ASSEMBLING SAME

RELATED APPLICATIONS

The present application claims priority under 35 U.S.C. §119(e) from U.S. Provisional Patent Application No. 61/489,869, filed May 25, 2011, which is incorporated by reference herein in its entirety.

TECHNICAL FIELD OF INVENTION

The present invention relates generally to assemblies and devices related to connecting cables and electrical devices.

BACKGROUND

Connectors can be used to connect cables, electronic devices, and/or other devices for a number of reasons and in a number of industries. Connectors often contain a number of contact pins which are received into corresponding female pin receptacles in a device. Conventional connectors available to users can be cumbersome and difficult to assemble and to use in the field, offering little flexibility in using such conventional connectors for specific purposes. Components of conventional connectors are often fabricated as a single piece or pre-assembled in a manufacturing setting. The manufacture of conventional connectors can be cumbersome and costly based on the configuration of the connector.

SUMMARY

Described herein are some embodiments of a device and assembly related to connectors. In some embodiments described herein, a device can comprise a retainer, a subretainer, and at least one contact pin. In some such embodiments, the subretainer can be removably coupled to the retainer by an attachment structure. The retainer can comprise at least one channel, and the subretainer can comprise at least one channel. The at least one contact pin can be positioned within the at least one channel of the retainer and the at least one channel of the subretainer.

In other embodiments, a device comprising a subretainer, a retainer, a retainer clip, a circuit web, and at least one contact pin is described herein. In some embodiments, the subretainer can comprise at least one channel. The retainer can comprise at least one channel. The retainer clip can comprise at least one channel. The at least one contact pin can be positioned within the at least one channel of the subretainer, the at least one channel of the retainer, and the at least one channel of the retainer clip. The at least one contact pin can be removably secured within the device upon the coupling of the retainer clip to the retainer. In some embodiments, the retainer clip can comprise at least one protrusion that removably couples the retainer clip to the retainer. In some embodiments, the circuit web can be positioned within the subretainer.

In yet other embodiments, a method of manufacturing is described herein. In some embodiments, the method of manufacturing can include constructing at least one leadframe comprising a circuit web; forming a subretainer comprising at least one channel upon the leadframe; positioning a retainer comprising at least one channel upon the subretainer; inserting at least one contact pin into the at least one channel of the retainer; and attaching a retainer clip to the retainer such that the at least one contact pin protrudes through the at least one channel of the retainer clip.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
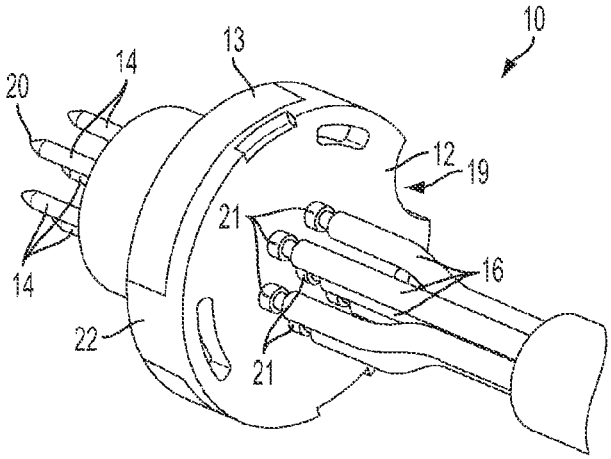
FIG. 1 is a perspective view of a connector device having wires according to one embodiment of the present invention.

Certain aspects and embodiments of the present invention relate to connector devices and assemblies, and methods of making the same. Some embodiments described herein can be used as an interface between a device and a cable or control panel. The connector devices or assemblies and methods of making the same described herein can provide a structure to support a plurality of contact pins or terminals. In some embodiments, the connector devices or assemblies and methods of making the same described herein can provide components to facilitate connection or soldering processes to the contact pins or terminals.

In some embodiments described herein, a device can comprise a retainer, a subretainer, and at least one contact pin. In some embodiments, the subretainer can be removably coupled to the retainer by an attachment structure. The retainer can comprise at least one channel, and the subretainer can comprise at least one channel. The at least one contact pin can be positioned within the at least on channel of the retainer and the at least one channel of the subretainer.

In some embodiments, the at least one contact pin can be secured within the retainer and subretainer upon the coupling of the retainer and the subretainer. In some embodiments, the attachment structure can comprise a clip. In some embodiments, the clip can include a protrusion that can provide a structure to secure the clip (and the subretainer) to the retainer. In some embodiments, the attachment structure can comprise a sufficiently rigid, but flexible, material to allow the clip to be reconfigured and adjusted to affix and remove the subretainer to the retainer. In some embodiments, the attachment device can comprise a fastener, tab, quick-connect coupling, or other structure to facilitate a coupling of the subretainer and the retainer.

In some embodiments, the contact pin can comprise a plurality of sections. In some embodiments, the sections of the contact pins can each comprise a different cross-sectional dimension. In some embodiments, the contacts pins are generally cylindrical such that the cross sectional dimension is characterized as a diameter. In some embodiments, the contact pins may comprise a different shape, having a cross-sectional dimension or area of a polygon, for example a square or pentagon. In such embodiments, the sections of the contact pins can have different dimensions or areas.

In some embodiments, a contact pin can be positioned within the channel of the retainer and/or the channel of the subretainer, each having a corresponding cross-sectional dimension. In some embodiments, the cross-sectional dimensions of the channels can vary to position and/or secure the contact pins within the respective channel that has a corresponding or complementary cross-sectional dimension. In some embodiments, a plurality of contact pins can be positioned within a plurality of channels of the retainer and a plurality of channels of the subretainer. In some embodiments, each contact pin is associated with a particular channel in the retainer and a channel in the subretainer.

In some embodiments, the device can include a housing. In some embodiments, the housing can comprise a structure to protect the device. In some embodiments, the housing can comprise a structure to facilitate connecting the device to a control panel or other electrical device. The housing can comprise a cavity into which the device can be positioned.

In some embodiments, the housing comprises at least one tab. In some embodiments, the at least one tab can flex upon the application of a force (for example in a radially outward direction) and then can return or rebound to its natural resting position upon the removal of the force upon the tab. In some embodiments, the tab in its natural resting position can abut the subretainer or other structure to secure the assembly or device into the housing.

In some embodiments, a device can comprise a subretainer, a retainer, a retainer clip, a circuit web, and at least one contact pin. In some embodiments, the subretainer can comprise at least one channel. The retainer can comprise at least one channel in some embodiments. The retainer clip can comprise at least one channel. The channel of the retainer, the channel of the subretainer, and the channel of the retainer clip can be substantively aligned to receive a contact pin. In some embodiments, the retainer, the subretainer, and the retainer clip can each comprise a plurality of channels. Each of the plurality of channels of the retainer, the subretainer, and the retainer clip can be substantively aligned with one another such that a plurality of contact pins can be positioned within each of the plurality of channels. The at least one contact pin can be positioned within the at least one channel of the subretainer, the at least one channel of the retainer, and the at least one channel of the retainer clip. The at least one contact pin can be removably secured within the device upon the coupling of the retainer clip to the retainer. In some embodiments, the retainer clip can comprise at least one protrusion that removably couples the retainer clip to the retainer. In some embodiments, the circuit web can be positioned within the subretainer.

The circuit web can comprise a structure to facilitate the forming or construction of electrical circuits to transmit electrical signals. In some embodiments, the circuit web can comprise a metal cladded material. In some embodiments, the circuit web can comprise at least one solder point. In some embodiments, a wire can be soldered or otherwise coupled to the circuit web via the solder point. The solder point can be operably coupled to the at least one contact pin when the contact pin is positioned in the circuit web. Upon the wire being operably connected to the circuit web and the contact pin being operably connected to the circuit web, an electrical signal or transmission can transmitted or transferred via the wire to the circuit web to the contact pin. The circuit web can comprise any number of soldering points or additional configurations, depending, for example, on the number of desired circuits, the desired arrangement of circuits, the number of contact pins, and other factors.

In some embodiments, the circuit web can comprise a plurality of independent circuits. The circuit web can be bussed out or otherwise broken so that a controlled signal is transmitted through an individual circuit.

In other embodiments, a method of manufacturing is described herein. In some embodiments, the method of manufacturing can include constructing at least one leadframe comprising a circuit web; forming a subretainer comprising at least one channel upon the leadframe; positioning a retainer comprising at least one channel upon the subretainer; inserting at least one contact pin into the at least one channel of the retainer; and attaching a retainer clip to the retainer such that the at least one contact pin protrudes through the at least one channel of the retainer clip.

In some embodiments, a plurality of devices can be produced in a continuous manner. In some embodiments, the leadframes can be constructed in a series such that the leadframes can be separated at a desired point during the manufacturing process. In some embodiments, upon the separation of the individual devices and leadframes, portions of the leadframe can be removed from the assembled device.

The following sections describe various additional embodiments and examples with reference to the drawings in which like numerals indicate like elements and directional description are used to describe illustrative embodiments but, like the illustrative embodiments, should not be used to limit the present invention.

Figure 2:
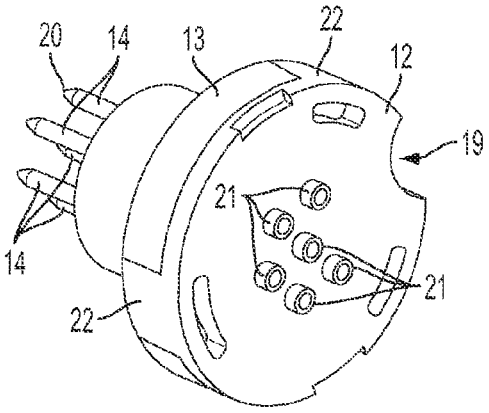
FIG. 2 is a perspective view of a connector device according to one embodiment of the present invention.

FIG. 1 shows a connector device 10 having a plurality of wires 16 connected to the connector device 10. The plurality of wires 16 are bundled within a cable. The connector device includes a subretainer 12, a retainer 13, and a plurality of contact pins 14. The plurality of contact pins 14 are positioned within a plurality of corresponding channels bored through the subretainer 12 and the retainer 13. The wires 16 are connected to the contact pins 14, for example by soldering, in proximity to the first end 21 of the contact pins 14. In the embodiment shown in FIG. 1, the connector device 10 comprises six contact pins 14. In other embodiments, the connector device can be configured to include more or less contact pins depending, for example, on the desired use of the cable, the equipment being used, the desired receiving port, and other factors. In some embodiments, the contact pins can be positioned in a different configuration, for example, a circular configuration. In some embodiments, the contact pins can be stamped rolled. FIG. 2 shows a connector device 10 without a plurality of wires being attached to the first end 21 of the contact pins 14. A second end 20 of the contact pins 14 can provide a structure or end to be connected to a receiving port in a control panel, device, or other electrical component.

Figure 3:
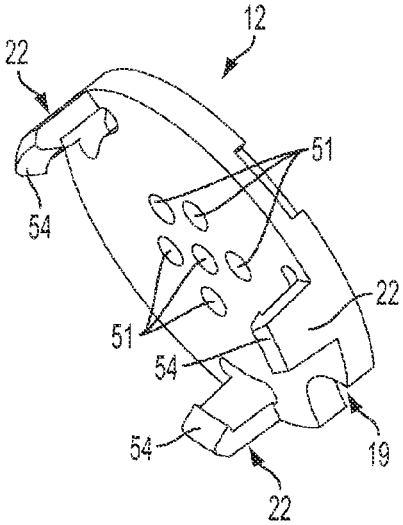
FIG. 3 is a rear perspective view of a subretainer according to one embodiment of the present invention.

The subretainer 12 is attached to the retainer 13 by a plurality of clips 22. In the embodiment shown in FIG. 1, two clips 22 are shown and a third clip is not visible in this view; however, additional clips can be positioned around the subretainer 12 and retainer 13. The plurality of clips 22, unattached to the retainer 13, are shown in FIG. 3. The connector device 10 has a notch 19 that can facilitate the positioning of the connector device 10 into a housing (discussed further below).

In some embodiments, a printed circuit board (not shown) can be operably connected to the contact pins 14. The printed circuit board can be connected at a position apart from the subretainer 12, for example, by a second set of wires. The printed circuit board can provide additional logic and electrical components for using a device.

FIG. 3 shows a subretainer 12 according to one embodiment of the present invention. The subretainer 12 includes a plurality of clips 22 each having a protrusion 54 at one end. Each protrusion 54 having a tab-like structure can provide a physical mechanism to facilitate the attaching and affixing of the subretainer 12 onto a retainer 13. In the embodiment shown in FIG. 3, three clips 22 having protrusions 54 are shown; however, additional or fewer clips can be employed on a subretainer 12 in other embodiments. The plurality of clips 22 can be comprised of a sufficiently rigid, but flexible material such that the clips 22 can removably secure the subretainer 12 to the retainer 13.

The subretainer 12 includes a plurality of channels 51. Contact pins (not shown) can be positioned within the channels 51. The subretainer 12 can be formed from a plastic material. In some embodiments, the subretainer 12 can be insert molded or fabricated using other techniques within the art.

Figure 4:
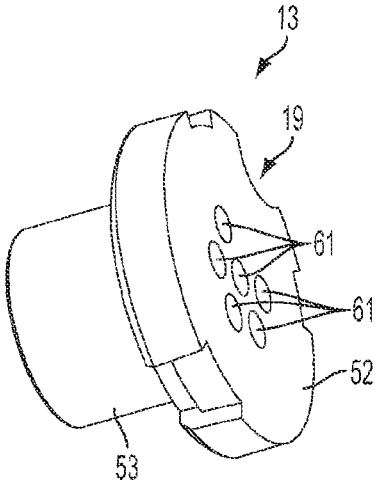
FIG. 4 is a perspective view of a retainer according to one embodiment of the present invention.

FIG. 4 shows a retainer 13 according to one embodiment of the present invention. The retainer 13 comprises a plurality of channels 61. The channels 61 of the retainer 13 correspond to the channels 51 of the subretainer 12 so that a plurality of contact pins may be positioned within both the channels 51 and the channels 61. The retainer comprises a top section 52 and a neck section 53. The top section 52 has a greater relative diameter than the neck section 53. The channels 61 extend through the top section 52 and the neck section 53. Except for the channels 61, the neck section 53 comprises a solid continuous structure. The retainer 13 can comprise a plastic material. In some embodiments, the retainer 13 can be insert molded or fabricated using other techniques within the art. The solid structure of the retainer 13 can provide sufficient support for the plurality of contact pins 14 during operation and connecting of the connector device 10.

Figure 5A:
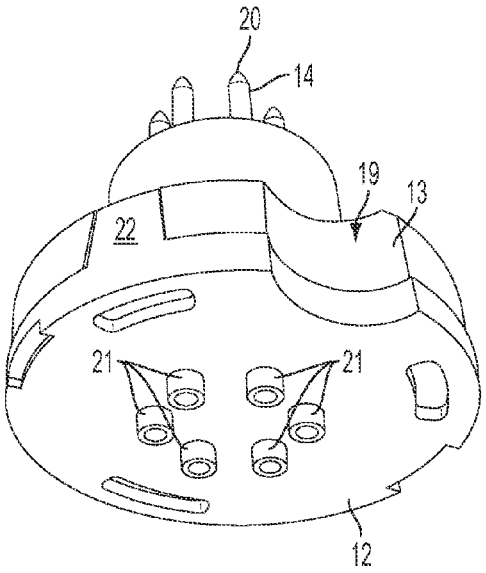
FIG. 5A is a front perspective view of a connector device according to some embodiments of the present invention.
Figure 5B:
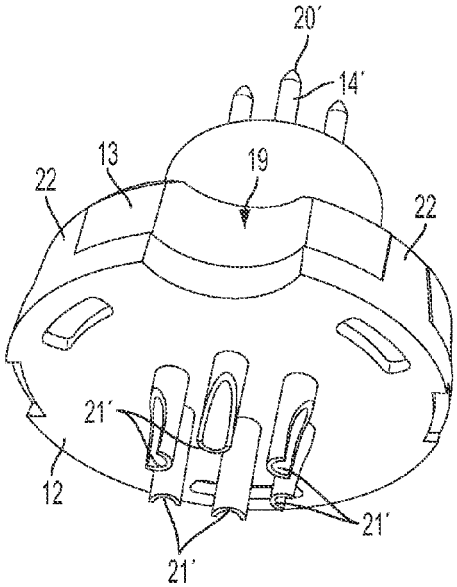
FIG. 5B is a front perspective view of a connector device according to some embodiments of the present invention.

In FIGS. 5A and 5B, a plurality of connector devices are shown each having a plurality of contact pins 14 and 14'. The first ends 21 and 21' of the contact pins 14 and 14' illustrate two embodiments that can be utilized with the connector devices of the present invention. The contact pin 14 having a first end 21 can provide a generally circular surface to directly solder a wire in the cavity created by the generally circular surface. In the second embodiment, the contact pin 14' comprising a first end 21' includes a scalloped solder cup structure. The scalloped solder cup of the first end 21' can provide a structure that may facilitate soldering of a wire directly to the contact pin 14'. For example, the scalloped solder cup structure of the first end 21' may provide a structure of surface that assists in placement of the wire properly at the contact pin 14' and may provide a reservoir to assist in the application of the solder in the soldering process.

Figure 6A:
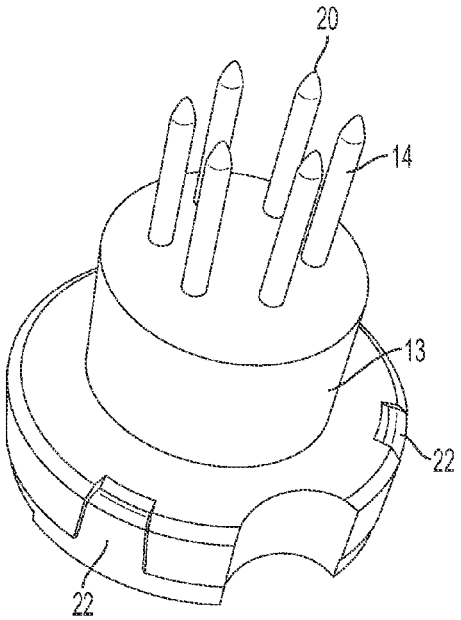
FIG. 6A is a rear perspective view of a connector device according to some embodiments of the present invention.
Figure 6B:
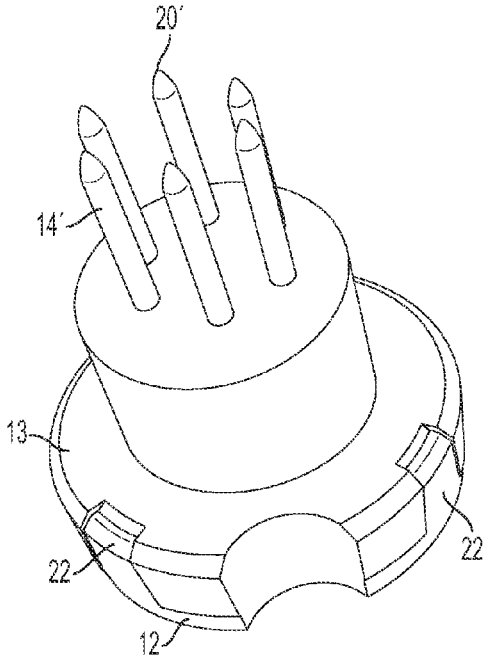
FIG. 6B is a rear perspective view of a connector device according to some embodiments of the present invention.

FIGS. 6A and 6B show a rear perspective view of the plurality of connector devices shown in FIGS. 5A and 5B. The clips 22 of the subretainer 12 are shown positioned about the retainer 13 to provide a sufficiently secure connection. The clips 22 can be made of a material(s) that provide a structure with sufficient rigidity and flexibility such that the configuration of the clips 22 can be adjusted to place and/or remove the subretainer 12 from its position upon the retainer 13. In some embodiments, the clips 22 can be formed from a plastic material.

Figure 7:
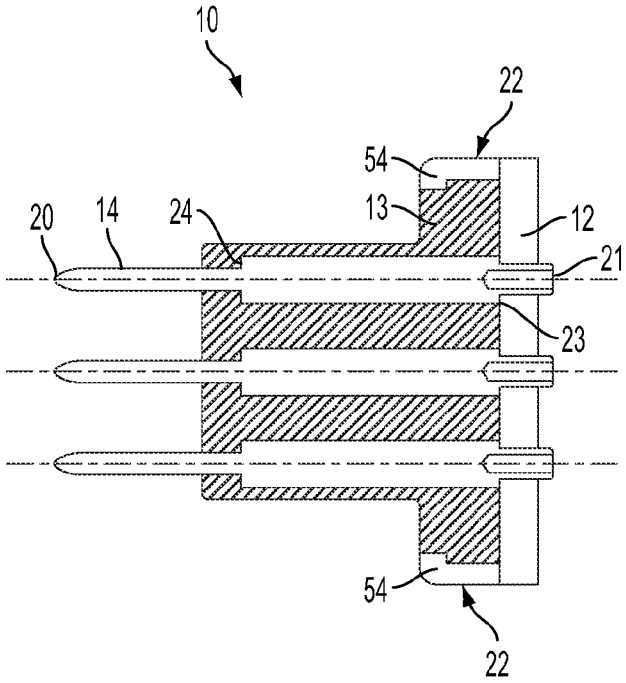
FIG. 7 is a cross sectional view of a connector device according to one embodiment of the present invention.

FIG. 7 shows a cross-sectional view of a connector device 10. The connector device 10 can be assembled by inserting a plurality of contact pins 14 into the retainer 13. The contact pins 14 are inserted such that the second end 20 of the contact pins 14 extend through the retainer 13. But for the channels 61 (shown in FIG. 4), the retainer 13 comprises a solid structure in the embodiment shown.

Figure 13:
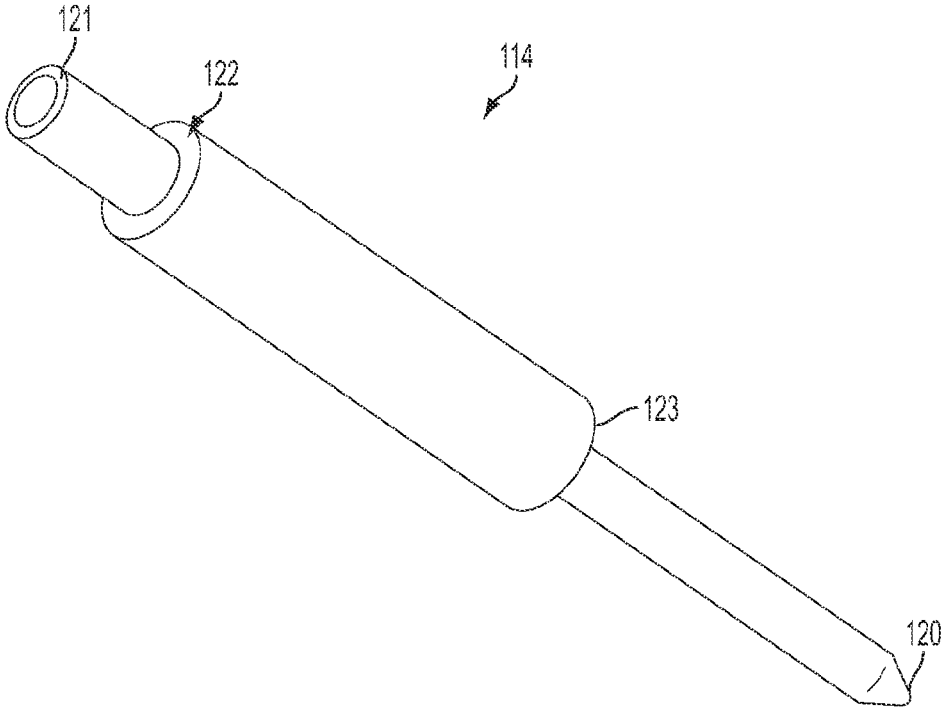
FIG. 13 is a perspective view of a contact pin according to one embodiment of the present invention.

The contact pins 14 comprise a generally cylindrical body portion having different sections with different diameters. By varying the diameter of the contact pins 14, the middle section of the contact pin 14 comprises a larger diameter than the end section near the second end 20 of the contact pin 14, thus creating a first stop surface 23 and a second stop surface 24. The first stop surface 23 and the second stop surface 24 provide a shelf-like feature which can provide a physical obstruction to prevent the contact pins 14 from undesired placement or movement during use and assembly. The channels 61 have a corresponding varying diameter that complements the contact pins 14. FIG. 13 shows an exemplary contact pin 114 that may be used in a connector device 10.

As the contact pins 14 are inserted into the retainer 13, the contact pins 14 pass through the channel 61 until the second stop surface 24 contacts the corresponding shelf of the retainer 13 preventing any further movement of the contact pins 14 in the direction toward the second end 20.

The subretainer 12 can next be positioned upon the retainer 13 and the contact pins 14. The first end 21 of the contact pins 14 extend through the channels 51 of the subretainer 12. The clips 22 having protrusions 54 are affixed around the retainer 13 to provide a removably secure connection of the subretainer 12 and the retainer 13. The first stop surface 23 of the contact pins 14 is substantially flush with the bottom surface of the subretainer 12. As the channels 51 have a diameter that corresponds to the first end 21 of the contact pins 14 (and is less than that of the middle section of the contact pins 14), the subretainer 12 prevents any further movement of the contact pins 14 in the direction toward the first end 21. A portion of the contact pins 14 at the first end 21 extend beyond the boundary of the subretainer 13. In some embodiments, the first end 21 may extend more or less, or may be substantially flush with the top surface of the subretainer 13. In some embodiments, the contact pins 14' shown in FIGS. 5 and 6 can be used in the connector device 10. In other embodiments, contact pins having a different shaped first end can be used.

Figure 8:
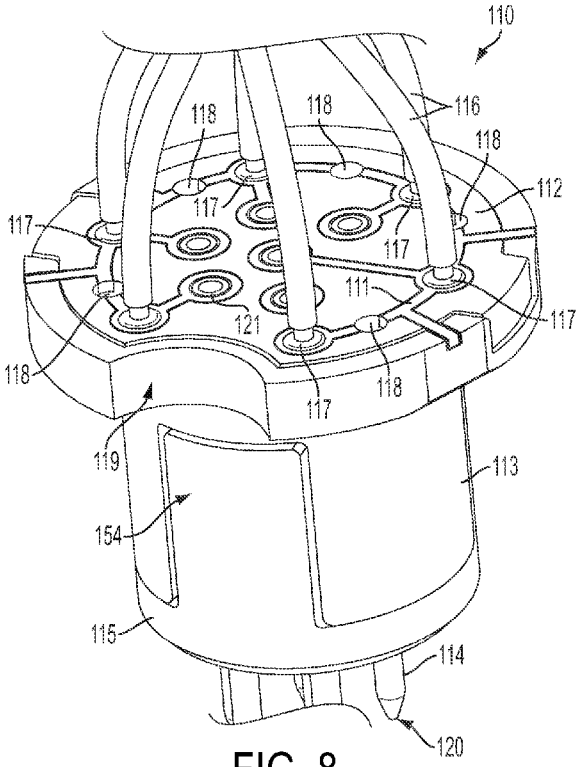
FIG. 8 is an top perspective view of a connector device having wires according to one embodiment of the present invention.

FIG. 8 shows a top perspective view of a connector device 110. The connector device 110 has a plurality of wires 116 connected to the connector device 110. The connector device includes a circuit web 111, a subretainer 112, a retainer 113, a plurality of contact pins 114, and a retainer clip 115. In some embodiments, the subretainer 112 can be formed from a plastic material. In some embodiments, the circuit web 111 can comprise a metallic clad material.

The circuit web 111 is positioned within the subretainer 112. The circuit web 111 comprises a plurality of solder points 117. In the connector device 110 shown in FIG. 8, the plurality of wires are soldered to various soldering points 117. In the embodiment shown in FIG. 8, the circuit web 111 comprises a plurality of openings 118 where the clad material has been bussed out. The openings 118 can divide the circuit web 111 into a plurality of independent circuits. In other embodiments, the circuit web 111 can comprise fewer or additional soldering points or additional configurations, depending, for example, on the number of desired circuits, the desired arrangement of circuits, the number of contact pins, and other factors. In other embodiments, the circuit web 111 can comprise fewer or additional openings 118.

The subretainer 112 has a generally circular shape. In the embodiment shown in FIG. 8, the subretainer comprises a shape that provides a notch 119. The notch 119 can facilitate the positioning of the connector device 110 into a housing (not shown). The retainer 113 has a generally cylindrical shape with a shape complementary to notch 119. The retainer clip 115 has a generally circular shape with a plurality of protrusions 154 extending from the base of the retainer clip 115. The plurality of protrusions 154 provide a structure to secure the components of the connector device 110. In some embodiments, the retainer clip 115 can be formed from a material to provide signal noise reduction. In some embodiments, the retainer clip 115 can provide a structure to removably secure the plurality of contact pins into the device. In some embodiments, the retainer clip 115 provides a physical structure or obstruction to prevent the plurality of contact pins 114 from moving in the direction of the second end 120.

The plurality of contact pins 114 extend through the connector device 110. A first end 121 of the contact pins 114 is positioned at a top surface of the subretainer 112. A second end 120 of the contact pins 114 extends from the bottom surface of the retainer clip 115. The second end 120 of the contact pins can be connected to an electrical panel, device, or other component. The plurality of contact pins 114 are operably connected to the plurality of wires 116 via the circuits of the circuit web 111. As each wire 116 is soldered to the soldering point 117, the cladding material between the soldering point 117 transmits or conducts any electrical current, signal, or transmittal to the contact pins 114 at the first end 121. In other embodiments, the plurality of wires 116 can be soldered directly to the first end 121 of each of the contact pins 114.

In some embodiments, a printed circuit board (not shown) can be operably connected to the contact pins 114. The printed circuit board can be connected separate or apart from the circuit web 111, for example, by a second set of wires. The printed circuit board can provide additional logic and electrical components for using a device.

Figure 9:
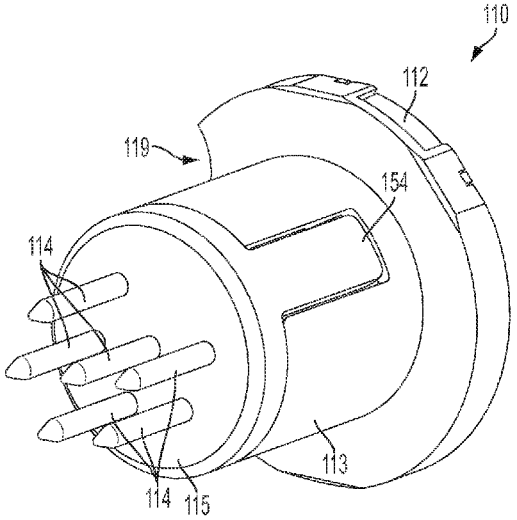
FIG. 9 is a bottom perspective view of a connector device according to one embodiment of the present invention.

FIG. 9 shows a rear perspective view of the connector device 110. The plurality of contact pins 114 extend through and from the retainer clip 115. The protrusions 154 of the retainer clip 115 extend up from the base of the retainer clip 115 into a neck region of the retainer 113. A portion of the subretainer 112 is shown at the top portion of the retainer 113.

Figure 10:
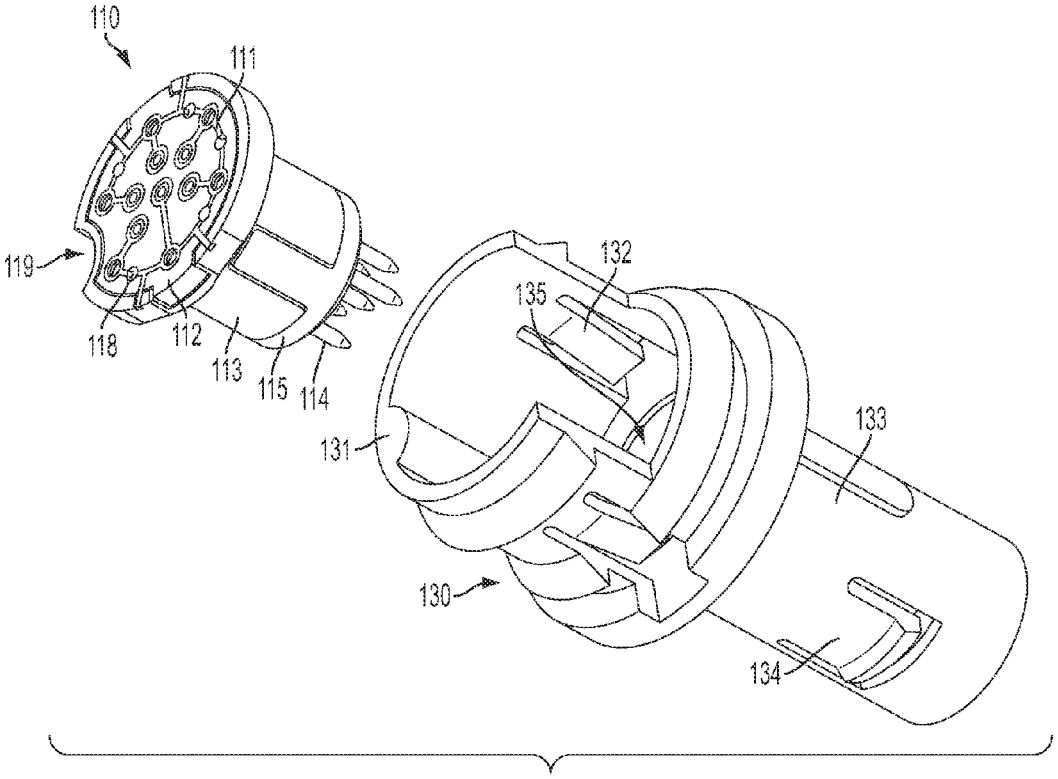
FIG. 10 is an exploded perspective view of a connector device and a housing according to one embodiment of the present invention

FIG. 10 shows an exploded view of the connector device 110 and a housing 130. The housing 130 comprises an alignment structure 131, a plurality of tabs 132, a body portion 133, a cavity 135, and plurality of attachment devices 134. The connector device 110 can be inserted into the cavity 135 of the housing 130 to facilitate use in the field. The notch 119 of the connector device 110 can be aligned with the alignment structure 131 of the housing 130 to ensure proper positioning and orientation of the connector device 110. The housing 130 is provided for illustrative purposes and that other configurations and structures of the housing can be designed and used, for example, but not to be considered limiting, the external shape of the housing can be adjusted to correspond to the shape of the mating end in a control panel.

Figure 11:
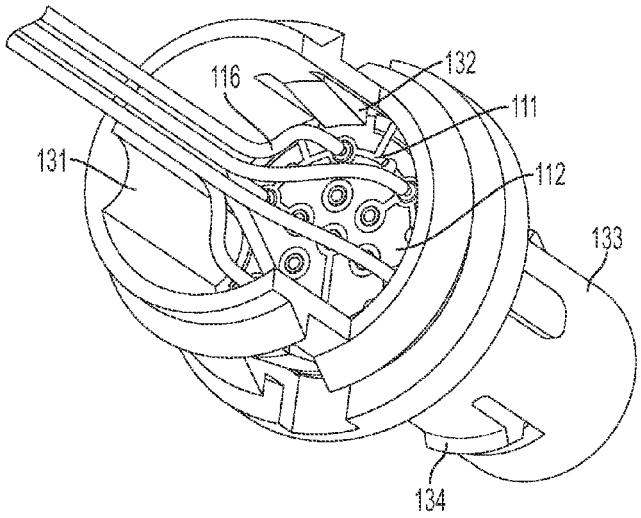
FIG. 11 is a top perspective view of a connector device and housing according to one embodiment of the present invention.

The tabs 132 can comprise a plastic material such that the tabs 132 are sufficiently rigid and flexible to secure the connector device 110 in the housing 130. Upon inserting the connector device 110 into the cavity 135, the tabs 132 are flexed outwardly (into the wall of the housing) as the connector device 110 passes. Once the connector device 110 is seated within the housing 130 (and passes the tabs 132), the tabs 132 return to their initial position. FIG. 11 shows connector device 110 properly seated in the housing 130 with the tabs 132 in their initial position locking the connector device 110 in position. The tabs 132 lock the connector device 110 into place by providing a physical obstruction to prevent any undesired movement in the direction of the wires.

The body 133 of the housing 130 is the portion exposed when the assembly is connected to a control panel or device used by an end-user. The plurality of contact pins 114 extend from the retainer clip 115 into a cavity created by the body 133 of the housing. The body 133 can protect the contact pins 114 from radial forces or stresses. The attachment devices 134 can provide a snap-fit like connection to create a removably secure connection to a control panel or electrical device or component. The attachment devices 134 can be made of a sufficiently rigid but flexible material, such as a plastic material, to attach the housing to a structure. In other embodiments, the housing may be integral to a control panel or other device such that the connector device is positioned directly into the control panel or other device.

FIG. 11 shows the connector device 110 positioned within the housing 130 with a plurality of wires 116 connected to the connector device 110. In some embodiments, a resin or gel like material can be applied in the cavity portion of the housing on the top surface of the subretainer 112. The resin or gel can provide a seal or protection from ingress of moisture or other liquid into the connector.

Figure 12:
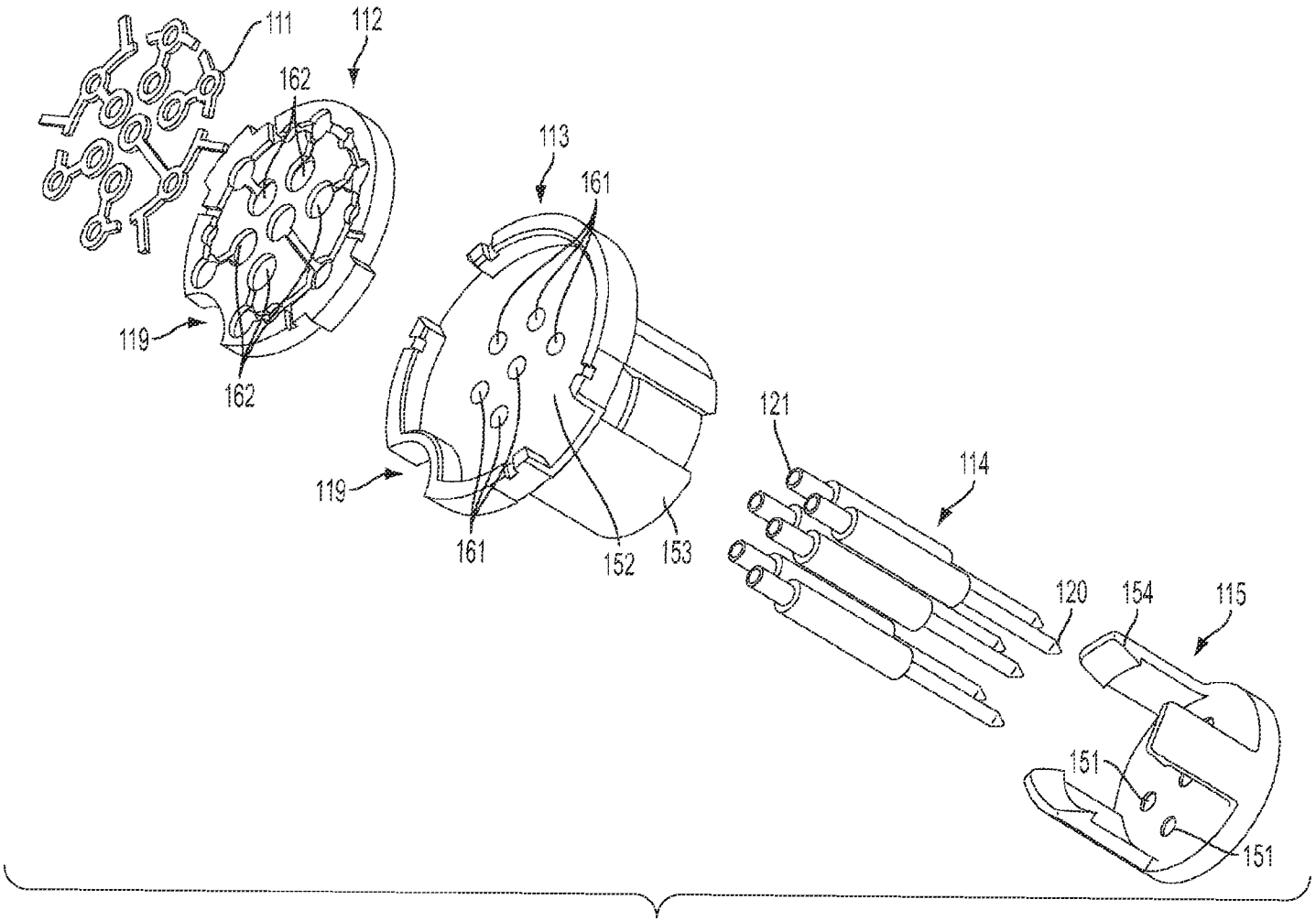
FIG. 12 is an exploded perspective view of a connector device according to one embodiment of the present invention.

FIG. 12 shows an exploded view of the connector device 110. The circuit web 111 sits within the subretainer 112. The subretainer 113 comprises a plurality of channels 162 through which the first end 121 of the contact pins 114 can extend. The subretainer 112 is positioned about the retainer 113 upon the top surface 152. A plurality of channels 161 extend through the retainer 113. The channels 161 correspond and complement the channels 162 of the subretainer 112. But for the channels 161, the neck section 153 of the retainer 113 is a continuous, solid structure. The solid structure of the retainer 113 can provide sufficient support for the plurality of contact pins 114.

The first ends 121 of the contact pins 114 are inserted into the bottom end of the retainer 113 and inserted until the first end 121 reaches the subretainer 112. Once the contact pins 114 are positioned within the retainer 113, the retainer clip 115 is connected to bottom of the retainer 113.

As shown in FIG. 13, the contact pins 114 comprise a generally cylindrical body portion having different sections with different diameters. By varying the diameter of the contact pins 114, the middle section of the contact pin 114 comprises a larger diameter thus creating a first stop surface 122 and a second stop surface 123. The first stop surface 122 and the second stop surface 123 provide a shelf-like feature which can provide a physical obstruction to prevent the contact pins 114 from undesired placement or movement during use and assembly. In some embodiments, the channels 161 of the retainer 113 have a corresponding varying diameter that complements the contact pins 114.

As the contact pins 114 are inserted into the retainer 113, the contact pins 114 pass through the channels 161 until the first stop surface 122 contacts the corresponding shelf of the retainer 113 or the bottom surface of the subretainer 112 preventing any further movement of the contact pins 114 in the direction toward the first end 121. To prevent movement of the contact pins 114 in the direction toward the second end 122, the retainer clip 115 is attached to the retainer 113. The channels 151 of the retainer clip 115 have a smaller diameter than the middle section of the contact pins 114. Thus, the retainer clip 115 provides a structure upon which the second stop surface 123 abuts.

Figure 14:
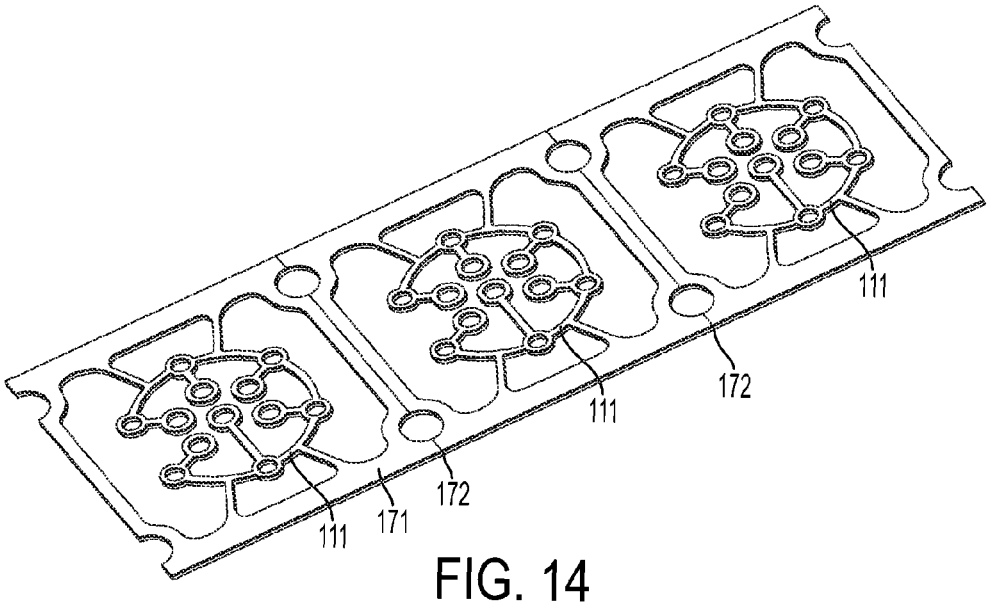
FIG. 14 is a perspective view of a plurality of leadframes comprising a circuit web according to one embodiment of the present invention.

FIG. 14 shows a plurality of leadframes 171 each comprising a circuit web 111. The plurality of leadframes 171 is representative of an exemplary manufacturing process of some embodiments of connector devices assemblies. In the embodiment shown in FIG. 14, three leadframes 171 are shown; one of ordinary skill in the art would appreciate that any number of leadframes 171 can be employed to facilitate the automation or manufacture of the connector device or assemblies. For example, in a mass production setting, the leadframes 171 can be constructed on a production line in a continuous manner. At a subsequent point in the manufacturing process, the leadframes 171 can be separated at a separation point 172.

Figure 15:
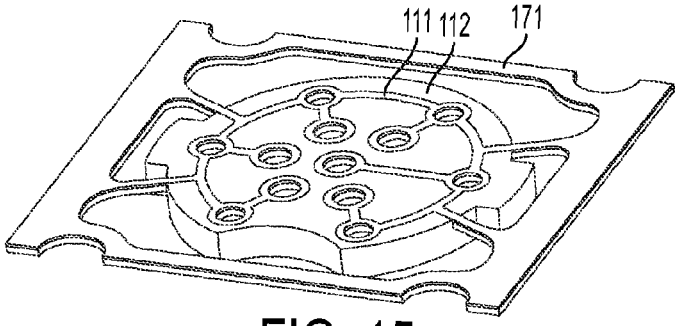
FIG. 15 is a perspective view of a subretainer and a leadframe according to one embodiment of the present invention.

FIG. 15 shows a representative leadframe 171 connected to the subretainer 112. The subretainer can be over-molded directly to the leadframe 171. During the manufacturing process, each leadframe 171 can be over-molded with a subretainer 112 at a certain point in the production line. In other embodiments, the subretainer 112 may be created by a mold and then physically placed upon the leadframe 171 in a preformed structure.

Figure 16:
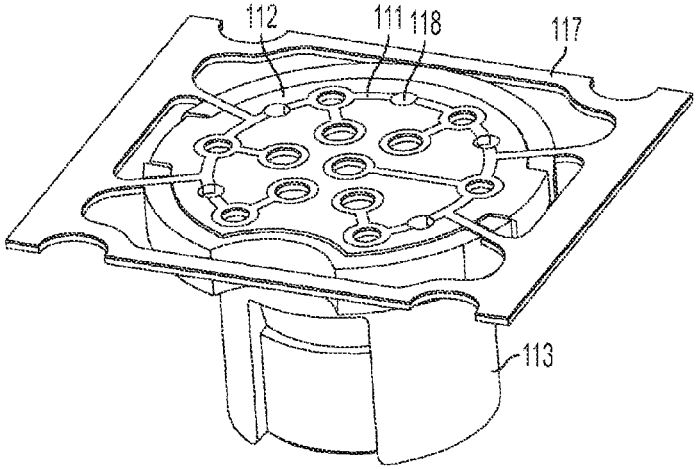
FIG. 16 is a perspective view of the assembly shown in FIG. 15 having a retainer according to one embodiment of the present invention.

FIG. 16 shows a representative leadframe 171 with a subretainer 112 and a retainer 113. The retainer 113 can be positioned directly upon the subretainer 112 and leadframe 171. In some embodiments, the retainer 113 is molded and affixed to the subretainer 112. The circuit web 111 in FIG. 16 also shows a plurality of openings 118 where the circuit web has been bussed out to provide breaks in the circuit web 111. The plurality of openings 118 can be created by a drill press or other boring device sufficient to create a separation.

Figure 17:
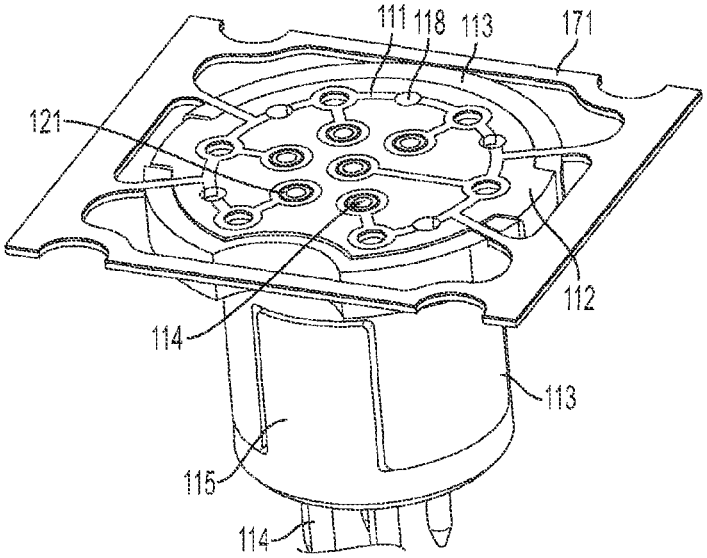
FIG. 17 is a perspective view of the assembly shown in FIG. 16 having a plurality of contact pins and a retainer clip according to one embodiment of the present invention.
Figure 18:
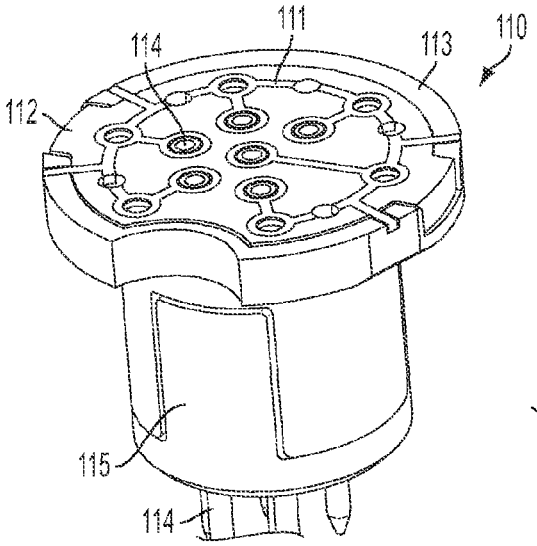
FIG. 18 is a perspective view of the assembly shown in FIG. 17 after removing the leadframe according to one embodiment of the present invention.
Figure 19:
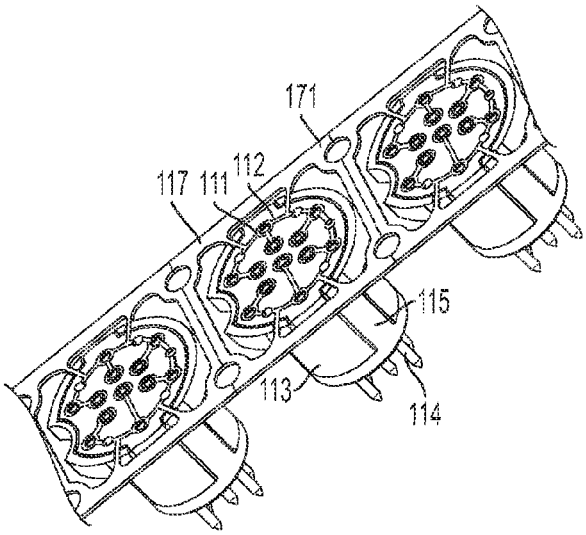
FIG. 19 is a perspective view of a plurality of connector assemblies according to one embodiment of the present invention.

FIG. 17 shows the next steps in an exemplary manufacturing process. The plurality of contact pins 114 are inserted into the retainer 113 at the end opposite of the leadframe 171. Subsequent to the insertion of the plurality of contact pins 114, the retainer clip 115 is affixed to the retainer 113. FIG. 18 next shows the removal of portions of the leadframe 171 to result in the connector device 110. FIG. 19 shows a representative plurality of connector devices or assemblies prior to the separation of the individual assemblies and prior to removal of the leadframes 171.

The foregoing description of the embodiments, including illustrated embodiments, of the assemblies, devices, and methods have been presented for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed:

1. A device comprising:

a retainer comprising at least one channel comprising a first diameter, and a stop surface;

a subretainer comprising at least one channel comprising a second diameter, wherein the second diameter is smaller than the first diameter of the at least one channel of the retainer, a bottom surface, and an attachment structure, wherein the subretainer is removably coupled to the retainer by the attachment structure; and at least one contact pin positioned within the at least one channel of the retainer and the at least one channel of the subretainer, wherein the at least one contact pin contacts the bottom surface of the subretainer such that the bottom surface of the subretainer prevents the at least one contact pin from moving in a direction toward the subretainer, and wherein the at least one contact pin contacts the stop surface of the retainer such that the stop surface of the retainer prevents the at least one contact pin from moving in a direction away from the subretainer.

2. The device of claim 1, wherein the at least one contact pin is secured within the retainer and the subretainer upon coupling of the retainer and the subretainer.

3. The device of claim 1, wherein the at least one contact pin comprises a plurality of sections where at least two of the sections comprise a different diameter.

4. The device of claim 1, wherein the at least one channel of the retainer has a plurality of sections where at least two of the sections comprise a different diameter.

5. The device of claim 1, further comprising a housing.

6. The device of claim 5, wherein the housing comprises at least one tab wherein the at least one tab abuts the subretainer to secure the coupled subretainer and retainer to the housing.

7. The device of claim 1, wherein the attachment structure comprises a clip having a protrusion.

8. The device of claim 1, wherein the at least one contact pin is operably connected to a printed circuit board.

9. A device comprising:

a subretainer comprising at least one channel;

a retainer comprising at least one channel;

a retainer clip comprising at least one channel and at least one protrusion, wherein the protrusion removably couples the retainer clip to the retainer;

a circuit web positioned within the subretainer;

at least one contact pin positioned within the at least one channel of the subretainer, the at least one channel of the retainer, and the at least one channel of the retainer clip and wherein upon the coupling of the retainer clip to the retainer, the at least one contact pin is removably secured in the device.

10. The device of claim 9, wherein the circuit web comprises at least one solder point.

11. The device of claim 10, wherein the at least one solder point is operably coupled to the at least one contact pin and at least one wire is soldered to the at least one solder point.

12. The device of claim 9, wherein the circuit web comprises a plurality of independent circuits.

13. The device of claim 9, wherein the circuit web comprises a metal-cladded material.

14. The device of claim 9, further comprising a housing.

15. The device of claim 14, wherein the housing comprises at least one tab where the at least one tab abuts the subretainer to secure the subretainer to the housing.

16. The device of claim 9, wherein the at least one contact pin is operably connected to a printed circuit board.

17. A method of manufacturing comprising:

constructing at least one leadframe comprising a circuit web;

forming a subretainer comprising at least one channel upon the leadframe;

positioning a retainer comprising at least one channel upon the subretainer such that the at least one channel of the retainer corresponds to the at least one channel of the subretainer;

inserting at least one contact pin into the at least one channel of the retainer;

attaching a retainer clip comprising at least one channel to the retainer such that the at least one contact pin protrudes through at least one channel of the retainer clip.

18. The method of claim 17, wherein forming the subretainer comprises over-molding the subretainer upon the leadframe.

19. The method of claim 17, further comprising:

removing portions of the leadframe.

* * * * *